United States Patent [19]

Neidich

[11] Patent Number: 4,931,022

[45] Date of Patent: Jun. 5, 1990

[54] CAM ACTUATED ELECTRICAL CONNECTOR

[75] Inventor: Douglas A. Neidich, Harrisburg, Pa.

[73] Assignee: InterCon Systems, Inc., Harrisburg, Pa.

[21] Appl. No.: 315,123

[22] Filed: Feb. 24, 1989

[51] Int. Cl.[5] ..... H01R 9/07; H01R 13/629

[52] U.S. Cl. ..... 439/310; 439/499; 439/606

[58] Field of Search ..... 439/606, 494, 495, 499, 439/447, 449, 736, 492, 493, 497, 498, 296, 310, 347, 368

[56] References Cited

U.S. PATENT DOCUMENTS

| | | | |
|---|---|---|---|
| 3,392,245 | 7/1968 | Asick | 439/347 |
| 4,094,564 | 6/1978 | Cacolici | 339/14 |
| 4,227,765 | 10/1980 | Neumann et al. | 339/143 |
| 4,349,239 | 9/1982 | Roberts | 439/259 X |
| 4,352,533 | 10/1982 | Murase et al. | 439/310 |
| 4,392,700 | 7/1983 | Showman | 439/310 X |
| 4,514,784 | 4/1985 | Williams et al. | 361/396 |
| 4,567,543 | 1/1986 | Miniet | 361/398 |
| 4,579,404 | 4/1986 | Lockard | 439/736 |
| 4,586,771 | 5/1986 | Kraemer et al. | 439/310 |
| 4,596,428 | 6/1986 | Tengler | 439/606 |
| 4,679,870 | 7/1987 | Pretchel | 439/736 |
| 4,700,996 | 10/1987 | August et al. | 439/268 |
| 4,718,860 | 1/1988 | Gobets et al. | 439/447 |
| 4,722,692 | 2/1988 | Tengler et al. | 439/92 |
| 4,725,243 | 2/1988 | Pretchel et al. | 439/395 |

*Primary Examiner*—Gary F. Paumen

*Attorney, Agent, or Firm*—Hooker, Thomas

[57] ABSTRACT

A shuttle assembly useful in an electrical connector includes a terminal portion, a cam portion and a ribbon cable sandwiched between the two portions. Electrical connections join terminals confined in the terminal portion to the ribbon cable.

9 Claims, 10 Drawing Sheets

CAM ACTUATED ELECTRICAL CONNECTOR

The field of the invention is electrical connectors, components and methods used for forming connections between one or more pairs of terminals, typically female terminals and male pins mounted in adjacent housings. The terminals of one housing are moved toward and into engagement with the terminals in the other housing by extending a cam transversely through the housing.

The prior art includes a cam operated electrical connector in which terminals are cam moved into engagement, the cam having a single cam surface which engages a body carrying one set of terminals. The body is shifted to form the connection but is not supported against cocking or tilting during the entire stroke, thereby risking misalignment between the respective terminal pairs.

The body is most likely to cock during initial engagement with the cam and during disengagement from the cam. Alignment problems can be particularly severe in miniature connector blocks of the type presently required by modern, miniature circuit elements where accumulated manufacturing tolerances may exceed as much as 25% of the spacing between adjacent terminals. In some cases accumulated tolerances can prevent proper mating of connector parts.

The invention relates to a miniature cam operated electrical connector having adjacent shuttle and pin housings with the shuttle housing supporting a number of movable shuttle assemblies and the pin housing holding a number of pins for engagement with terminals carried in the shuttle housings. Terminals in the shuttle housings are electrically connected to an adjacent printed circuit panel by means a flexible cable which permits movement of the housings relative to the panel.

The shuttle assemblies are moved from retracted positions in the housing into engagement with the pins in the pin housing by extending a cam through the shuttle housing in a direction transverse to the direction of forward movement. The cam has a pair of longitudinally offset cam surfaces both of which engage follower surfaces on either side of the shuttle assemblies to support the assemblies against cocking during the entire forward stroke. The shuttle assemblies are confined in the shuttle housing by alignment keys which, during forward movement of the assemblies, are moved into alignment slots in the pin housing to improve alignment between the shuttle assemblies and pins in the housing. The alignment achieved by moving the keys into the alignment slots is sufficient to move the beveled leadins surrounding each pin opening in the shuttle assembly over the rounded ends of the adjacent pins so that with further forward movement of the assemblies the pins are guided into mating engagement with their respective terminals held in the shuttle assembly, despite possible initial misalignment between the terminals and pins.

The pin housings include a shell and a plurality of two pin assemblies confined within the shell so that the assemblies float to a slight degree and facilitate shifting to achieve proper alignment during engagement of the pins with the terminals in the shuttle assemblies. Additionally, the cantilever pins may bend slightly as they mate with the terminals.

The pin assemblies each include a molded plastic body with a pair of flexible fingers, each surrounding one of the pins. Wires joined to the pins extend from the back of the body. One finger carries a latch engagable with a locking recess in the surrounding shell to hold the assembly in place. The assemblies may be freely removed from the shell as required by extending a tool into the mouth of the shell, engaging the end of the pin with the latch and flexing the arm away from the recess, thereby disengaging the latch and permitting withdrawal of the pin assembly from the shell. The pin assemblies also include tall and short back fins which polarize the assemblies and assure proper orientation when inserted into the shell.

The shuttle assemblies include separate terminal and cam portions with the terminals fitted in recesses in the terminal portions. The tail ends of the terminals extend through contact points on one finger of a flexible ribbon cable and into the over molded cam portion. This overmolded portion extends along the top and bottom of the terminal portion and surrounds a pair of integral locking projections which are undercut on their front and side faces to form the alignment keys used in positioning the shuttle assemblies during extension and retraction. The overmolded connection at the projections, together with a connections between the terminal tails and the plastic of the cam portion form a strong joint between the two portions permitting retraction of the shuttle assemblies without separating the two portions.

The flexible cable finger joined to the terminals extends rearwardly through the plastic of the overmolded terminal portion, exits from the back of the terminal portion and extends to a free end joined to the circuit panel. The free portion has sufficient length to permit extension and retraction of the terminal assembly without stressing the connections with the panel.

Plastic flows through openings are formed through the thickness of the ribbon cable finger embedded within the cam portion of the shuttle assembly to bond the cable in place and prevent stress loading of the soldered connections joining the conductive lines on the finger to the individual terminals in the terminal portion of the assembly. Molding tooling includes a blade and pin which engage and hold the finger in place in the mold cavity used during the overmolding operation.

The cam portions of the shuttle assemblies include a transversely extending openings having pairs of spaced like follower surfaces located on the front and rear walls. These surfaces engage longitudinally spaced like cam surfaces on the lead end of the cam. When the cam is moved through the openings the cam surfaces engage the spaced follower surfaces to support the shuttle assemblies against cocking or tilting as they are moved toward and away from the pin assembly.

The shuttle housing shell supporting the shuttle assemblies includes pairs of extension and retraction openings located through the end walls of the shell. These openings locate and orient the cam during extension and retraction movement through the shell with engagement and corresponding movement of the shuttle assemblies. The cam fits snugly within these openings in a single properly oriented position thereby preventing improper insertion of the cam and possible resultant injury to the shuttle assemblies.

Other objects and features of the invention will become apparent as the description proceeds, especially when taken in conjunction with the accompanying drawings illustrating the invention.

Figure 2:
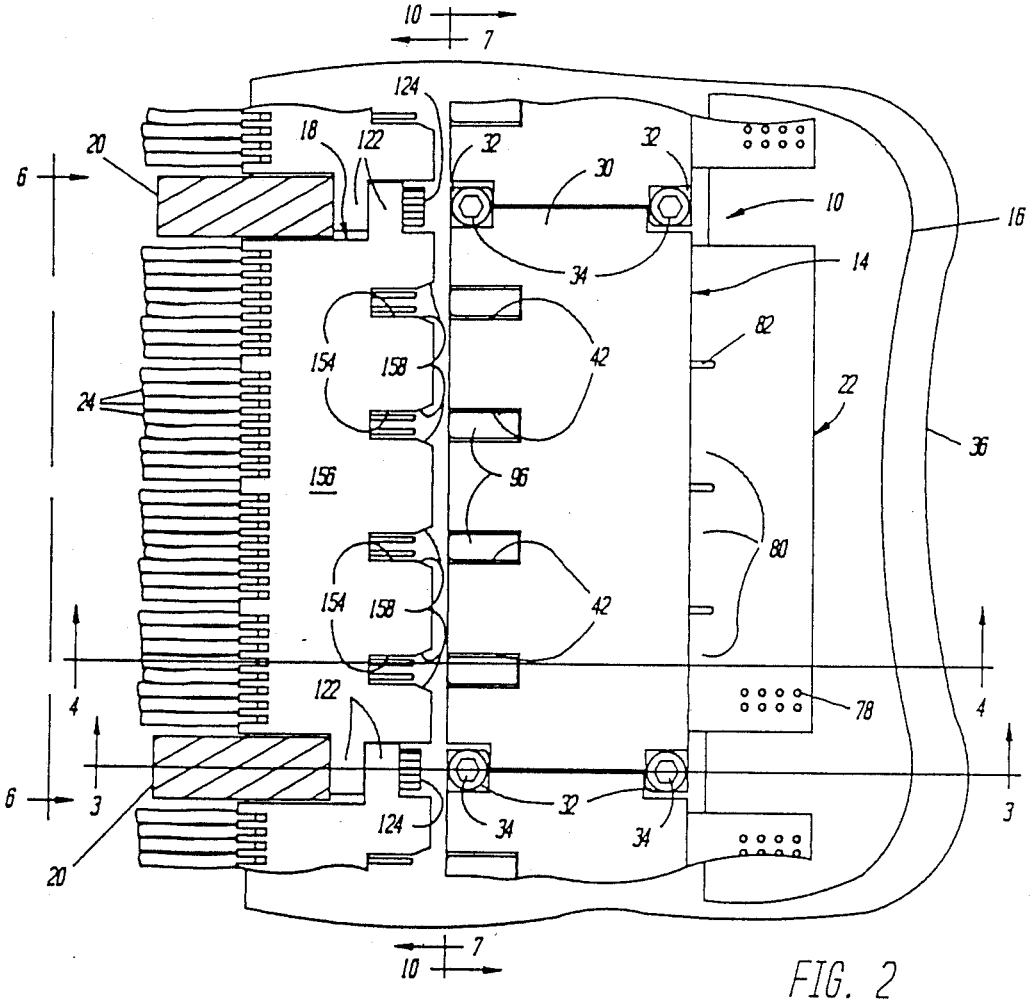
FIG. 2 is a top view of one of the connectors of the assembly.
Figure 3:
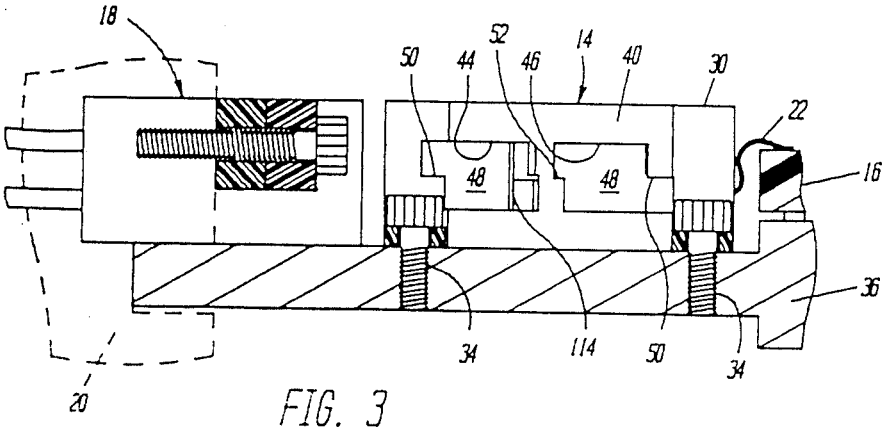
Figure 4:
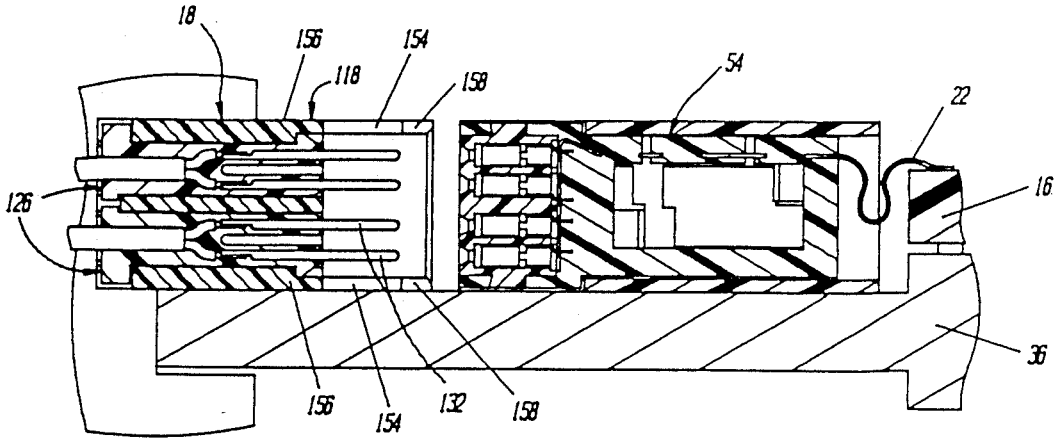
Figure 5:
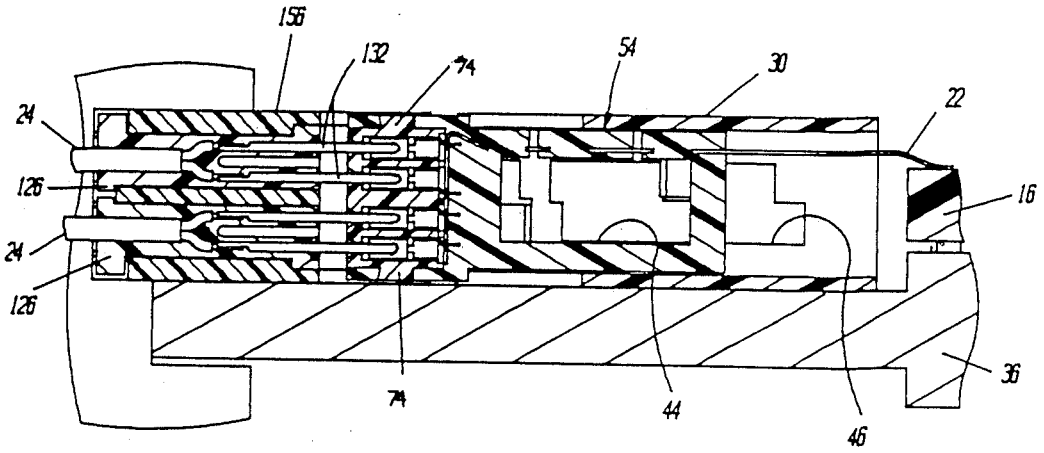
Figure 6:
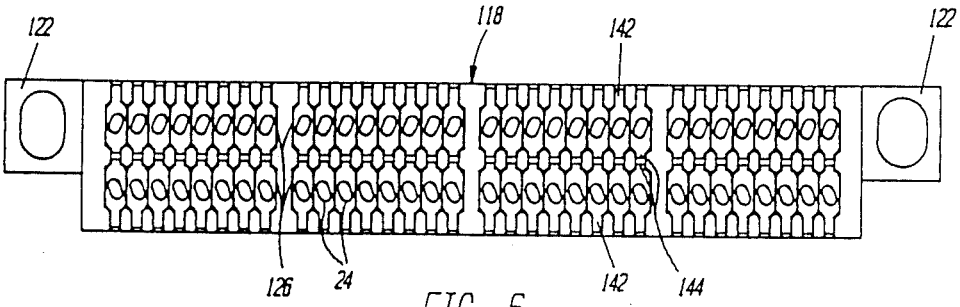
Figure 7:
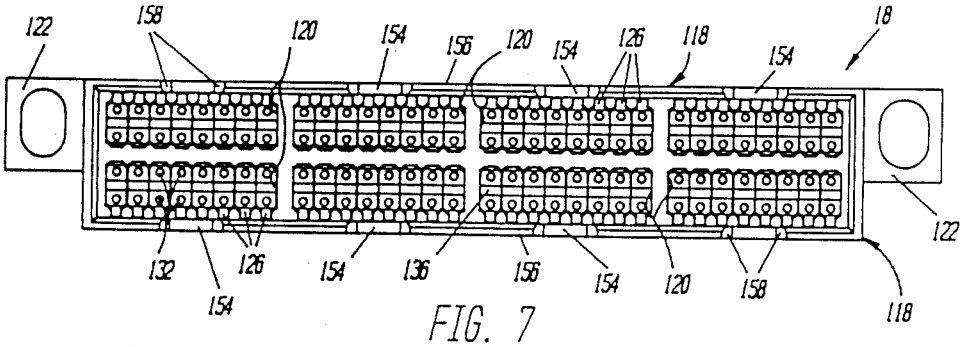
Figure 8:
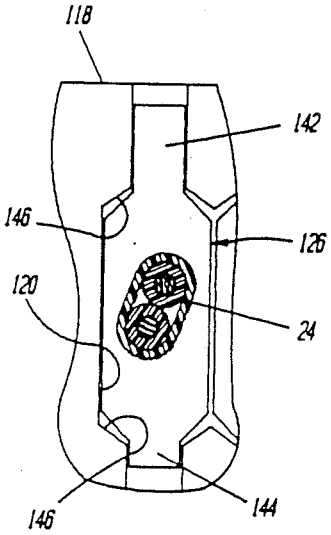
Figure 9:
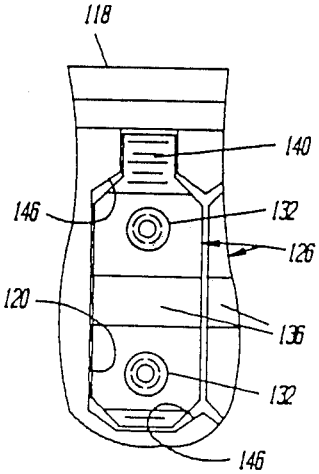
Figure 10:
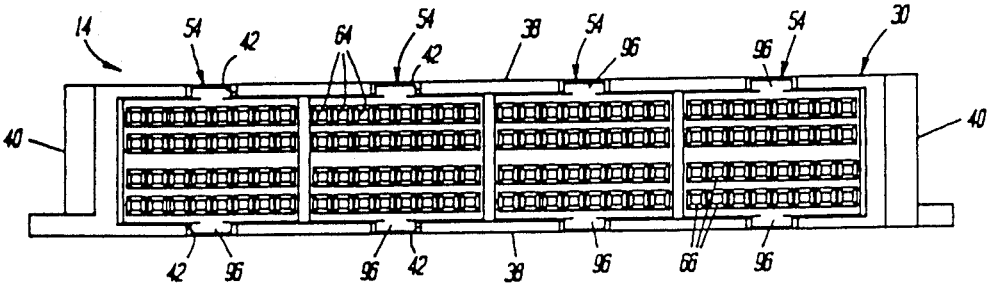
Figure 11:
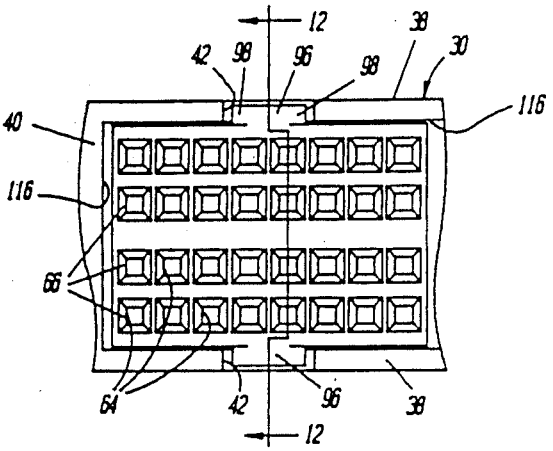
Figure 12:
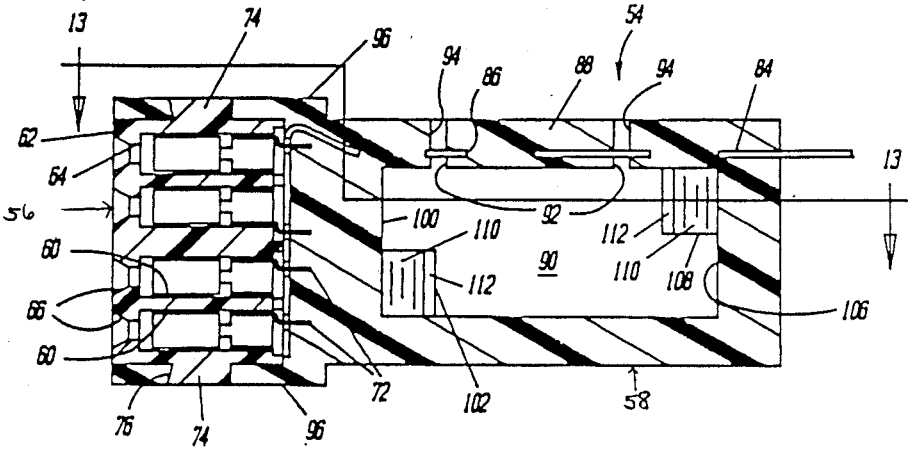
Figure 13:
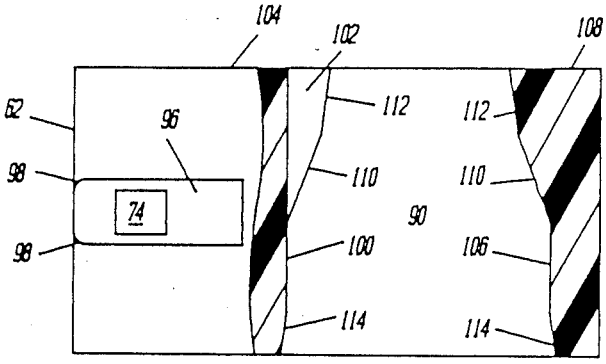
Figure 14:
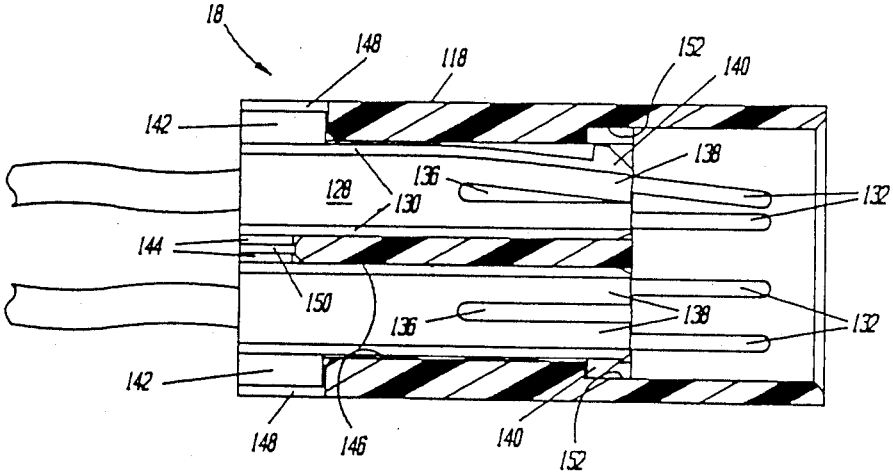

FIGS. 3 and 4 are sectional views taken along lines 3—3 and 413 4 respectively of FIG. 2;

FIG. 5 is a sectional view like FIG. 4 showing the connector in the engaged position;

FIGS. 6 and 7 are views taken respectively along lines 6—6 and 7—7 of FIG. 2;

FIG. 8 is an enlarged view of a portion of FIG. 6 showing a pin assembly in place;

FIG. 9 is an enlarged view of a portion of FIG. 7 showing the front of a pin assembly in place;

FIG. 10 is a view taken along line 10—10 of FIG. 2;

FIG. 11 is an enlarged view of a portion of FIG. 10 showing the front end of a shuttle housing;

FIG. 12 is a sectional view taken generally along line 12—12 of FIG. 11;

FIG. 13 is a sectional view taken along line 13—13 of FIG. 12;

FIG. 14 is an enlarged view of a portion of FIG. 4 showing one pin assembly in position to be withdrawn from the shell.

Figure 15:
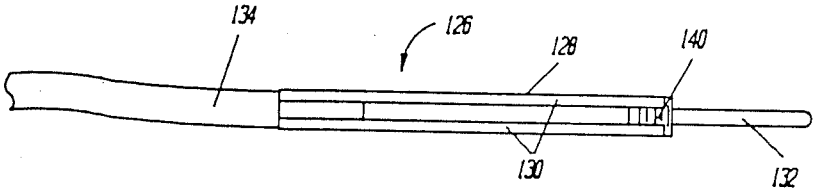
Figure 16:
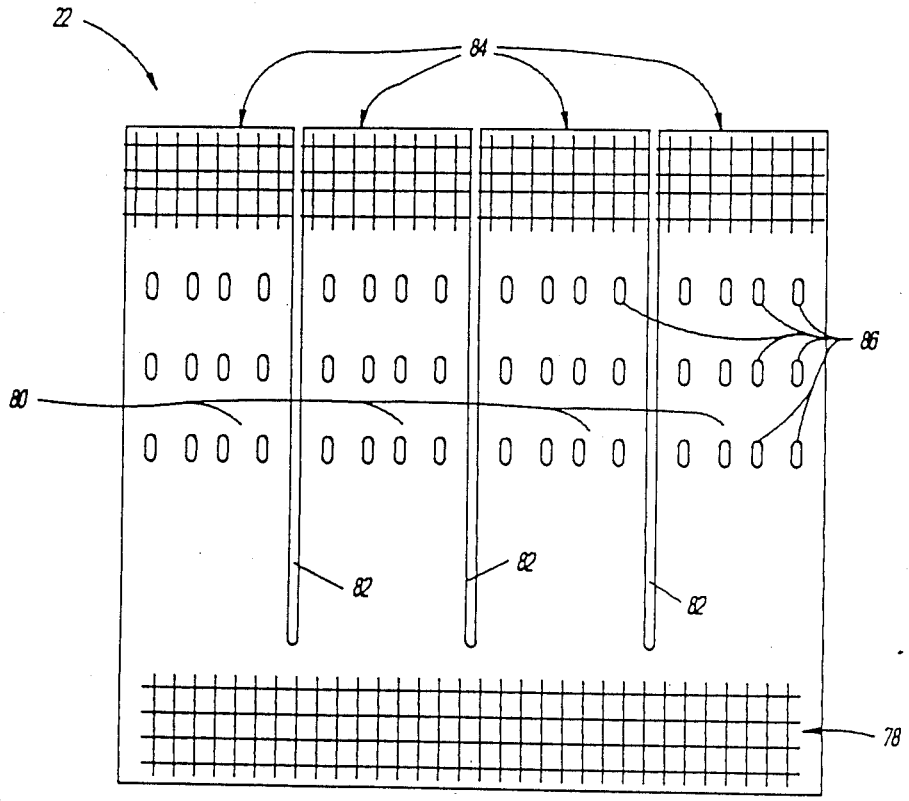
Figure 17:
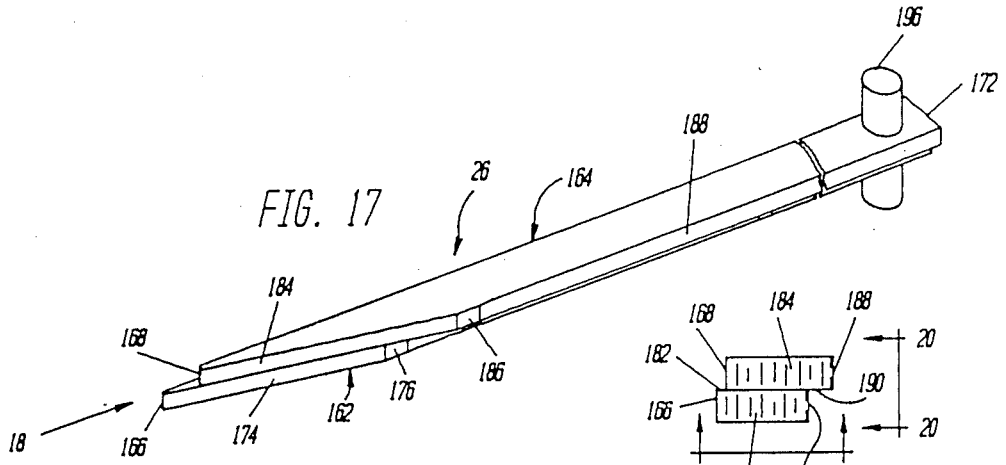
Figure 18:
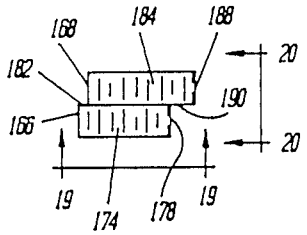
Figure 19:
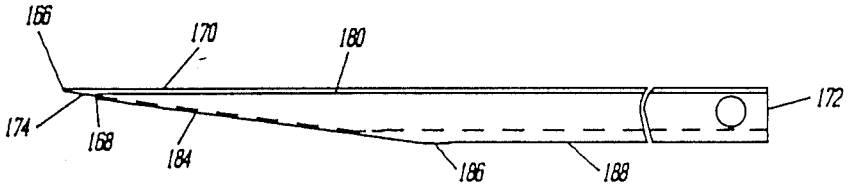
Figure 20:
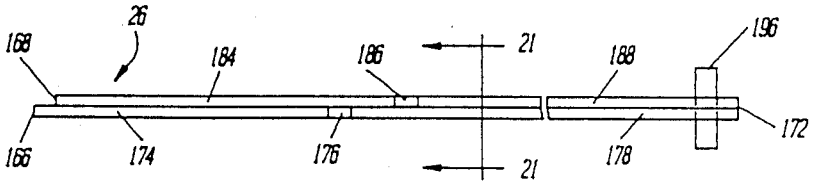
Figure 21:
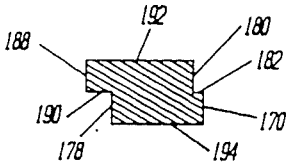
Figure 22:
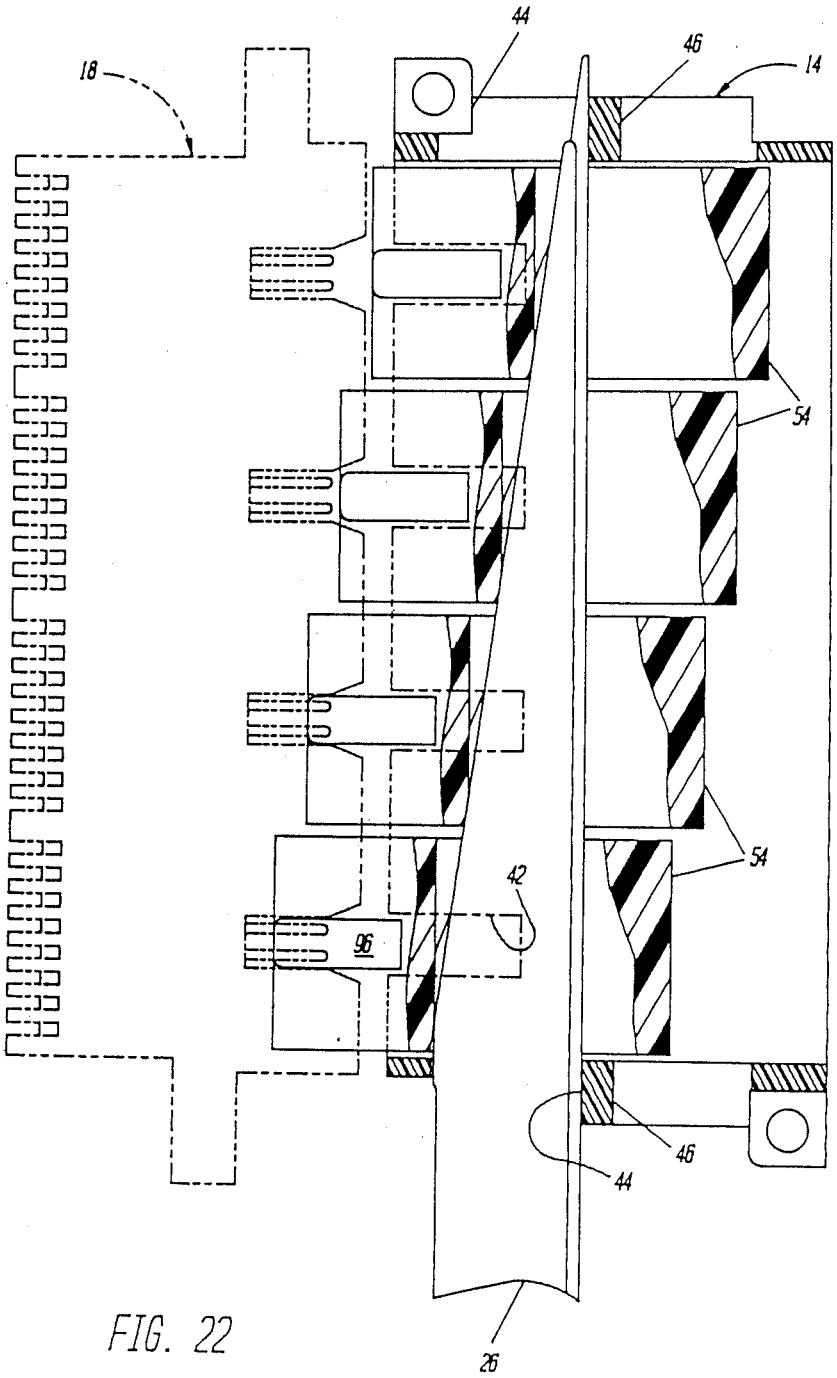
Figure 23:
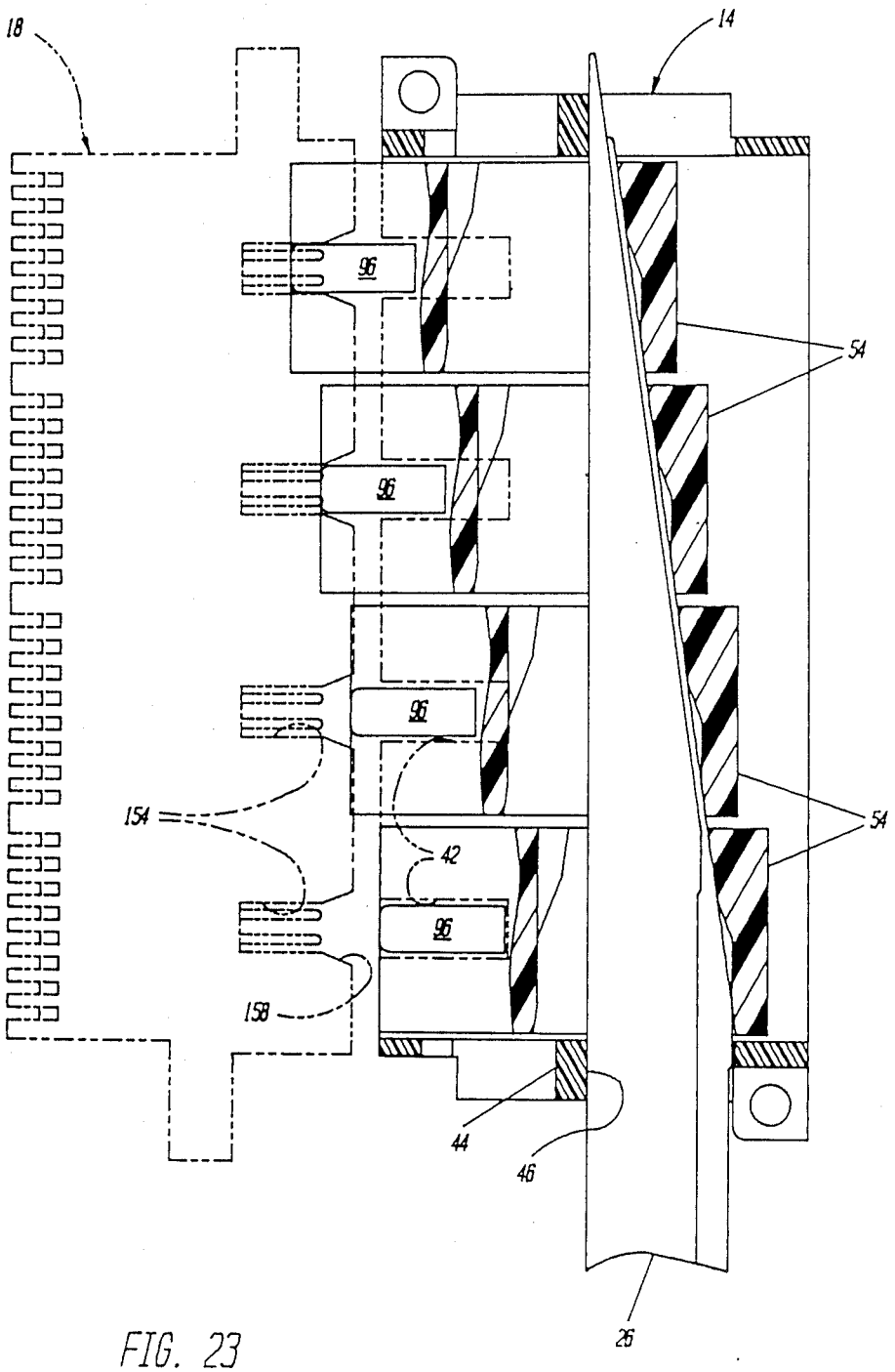

FIG. 15 is a top view of a pin assembly;

FIG. 16 is a plan view of a ribbon cable used in the connector;

FIG. 17 is a perspective view, partially broken away, of the actuating cam;

FIG. 18 is a view of the front of the lead end of the cam taken in the direction of arrow 18 of FIG. 17;

FIGS. 19, 20 and 21 are views taken respectively along lines 19—19, 20—20 and 21—21 of FIGS. 18, 18 and 20;

FIG. 22 is an enlarged sectional view showing insertion of the cam to move the shuttle assemblies forward to form electrical connections with the pin housing; and FIG. 23 is an enlarged view like FIG. 22 showing insertion of the cam to retract the shuttle assemblies from the pin housing.

DETAILED DESCRIPTION OF THE INVENTION

Figure 1:
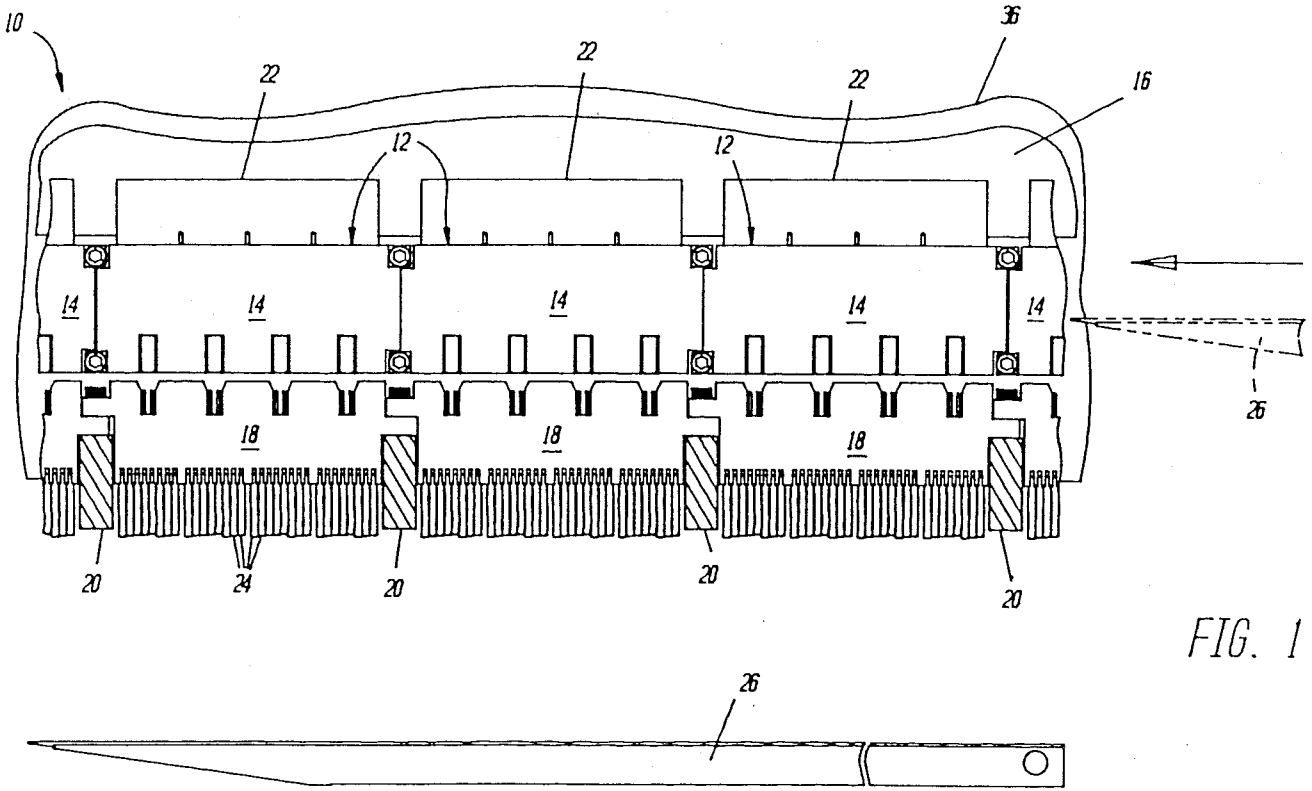
FIG. 1 is a top view of a connector assembly showing connectors and an actuating cam according to the invention.

As shown in FIG. 1, connector assembly 10 includes a series of adjacent cam actuated electrical connectors 12 each including a shuttle housing 14 mounted on circuit panel 16 and an opposed pin housing 18 mounted on spaced vertical frame rails 20. In one application a total of eighteen electrical connectors extend along the edge of the circuit panel adjacent the supports. A ribbon cable 22 forms electrical connections between terminals in each shuttle housing and contact pads on panel 16. Two conductor wires 24 are connected to pins carried in housing 18. An elongate cam 26 is moved through extension openings in the aligned shuttle housings 14 to move the terminals in the housings into electrical engagement with the pins in the pin housings. Following formation of the connection the cam is removed. The cam may be rotated 180 degrees and reinserted through different retraction openings in the shuttle housing to retract the terminals and break the electrical connections. The cam 26 extends through all of the conductors in assembly 10.

As shown in FIGS. 2 and 3, each shuttle housing 14 includes a hollow rectangular shell 30 which may be molded from a suitable plastic material. Mounting ears 32 are located on opposed opposite corners of the shell. Cap screws 34 extend through the ears to secure the shells on the upper surface of metal heat sink plate 36. See FIG. 3. The plate 36 extends under circuit panel 16 and into recesses formed in the rails 20. The panel 16 is suitably mounted on plate 36.

The shell 30 includes like top and bottom walls 38 and like end walls 40. Four spaced open alignment slots 42 are formed in the top and bottom walls of the shell and face the adjacent pin housing. Like cam extension openings 44 are formed through end walls 40 adjacent the pin housing 18. Like cam retraction openings 46 also extend through the ends walls 42 at locations away from the pin housing 18. As shown in FIG. 3, openings 44 and 46 are symmetrical, having the same shape, each including a rectangular central portion 48, a central long step 50 and a central short step 52. The steps face in opposite directions. The long steps 50 of openings 44 extend forwardly toward the pin housings 18 and the long steps of openings 48 extend rearwardly away from the pin housings 18. The hollow interiors of the shell are open adjacent housings 18 and panel 16.

Four shuttle assemblies 54 are confined within each shell 30 for movement toward and away from the adjacent pin housing. See FIGS. 10 through 14. Each housing includes a terminal portion 56 located adjacent the pin housing 18 and a cam portion 58 located away from the pin housing and integrally joined to the terminal portion. The terminal portion includes four horizontal rows of closely spaced terminal cavities 60 each opening on the front face 62 of the shuttle assembly through a narrow pin opening 64 and a beveled lead-in 66. A female disconnect terminal 68 is confined within each cavity 60 for forming an electrical connection with a pin in housing 18 extending through opening 64. Each terminal includes a channel section 70 frictionally holding the terminal in the cavity and a terminal tail 72 extending outwardly of the cavity, through the cable finger and into the body of cam portion 58. Integral rectangular locking projections 74 extend outwardly from the top and bottom surfaces of terminal portions 56 and are provided with undercut edges 76 on the front and side edges thereof.

Ribbon cable 22 is shown in FIG. 16. This cable includes flexible circuit lines of conventional design extending from a field 78 of contacts indicated generally on one end of the cable and along four separate cable fingers 80 separated by slots 82 to four individual fields 84 of contacts each located on the end of a cable finger 80. The individual lines extending from contacts in fields 84 along the length of the fingers 80 to contacts in field 78 pass around three rows of locking openings 86 formed through the thickness of the fingers.

The ribbon cable is mounted on circuit panel 16 with the contacts in field 78 electrically connected to contacts on the panel. Each finger 84 is connected to one of the shuttle assemblies of a connector 12 as shown in FIG. 12.

The terminals 68 are positioned in terminal cavities 60 with terminal tails 72 project rearwardly from the molded plastic terminal portion 56. Openings are formed through the contacts of fields 84 at the end of the appropriate ribbon cable finger 80 permitting positioning of the ends of the fingers over the tails as shown in FIG. 12 with the ends of the fingers resting flush on the terminal portions 56 and the terminal tails projecting through the openings. Electrical connections are then formed between the tails and the contacts, typically by a soldering process, although other types of electrical connections may be used as required.

All four terminal portions for a single electrical connector 12 are mounted on a single ribbon cable 22. Following this, the cable and terminal portions are positioned within a mold cavity and the cam portions 58 are overmolded onto the ribbon cable, the pre-formed terminal portions and the confined terminals. As shown in FIG. 12, the ribbon cable fingers are bent away from the terminal portion and are confined within the upper wall 88 of the cam portion. Plastic flows through openings 86 to secure the fingers in place.

Each cam portion includes a hollow interior passage 90 extending completely between the sides of the portion. The molds used for forming portion 58 include clamp ridges and support pins (not illustrated) which hold the ribbon cable fingers in place within the mold during molding. The ridges and pins form grooves 92 in the top of opening 90 extending across the width of the cam portion and holes 94 above the grooves in the top of wall 88 above the grooves and extending down to the cable finger. The fingers extend rearwardly of the cam portions and are free to flex individually as the shuttle assemblies are extended and retracted by cam 26.

During overmolding of the cam portion onto the terminal portion the terminal tails 72 are embedded within the cam portion plastic as shown in FIG. 12 and the cam portion plastic forms a pair of elongate alignment keys 96 on the top and bottom surfaces of the terminal portion 56. The keys surround the locking projections 74 and fill undercuts 76 to provide a tight bonded joint between the two portions. The joint assures that the portions are integrally secured together so that forces applied to the separate portions during movement of the shuttle assemblies do not separate the portions. As shown in FIG. 13, the keys 96 extend from the front face 62 of terminal portion 66 rearwardly and are integrally joined to the cam portion 58. The front corners 98 of guides 96 are rounded as shown. In the completed assembly the end of the ribbon cable is sandwiched between the terminal and cam portions.

Passage 90 in each shuttle assembly extends from side to side through the width of the cam portion and is generally rectangular in transverse cross section. See FIG. 12. The front wall 100 of passage 90 includes a cam projection 102 adjacent shuttle assembly side 104. The rear wall 106 of passage 90 includes a second cam projection 108 also adjacent side 104. As shown in FIGS. 12 and 13, projection 102 is on the bottom of the opening and extends upwardly slightly less than half the height of opening 90 and projection 108 is on the top of the opening and extends downwardly slightly less than half of the height of the opening. Each projection includes a relatively sharp ramp surface 110 extending outwardly from the adjacent wall to a relatively shallow, flat follower surface 112. Shallow angle follower surfaces 114 extend across the full height of walls 100 and 106 adjacent shuttle assembly side 116. The follower surfaces 112 and 114 on each passage wall parallel each other. The surfaces on opposite walls each slope at the same shallow angle relative to a transverse axis through the opening 90 and engage the same surfaces of cam 26.

The four shuttle assemblies of each connector 12 are held in shell 30 with keys 96 fitted within the slots 42 in the top and bottom of the shell as shown in FIGS. 10 and 11. The slots are wider than the keys and the height of the interior opening 116 in shell 30 is greater than the height of the shuttle assemblies assuring that the assemblies have a loose but constrained fit within the shell. This fit permits limited movement of the assemblies vertically and laterally as the assemblies are moved into and out of engagement with the pins in pin housing 18. When the shuttle assemblies are retracted out of engagement with the pin housing the follower surfaces 112 and 114 on the front wall 100 are located adjacent the rear portion of extension openings 44. See FIG. 3. When the shuttle assemblies are fully extended and the terminals engage the pins in housing 18 the follower surfaces 114 on the rear wall 106 are adjacent the front of retraction openings 46.

Pin housing 18 includes a molded plastic shell 118 having top, bottom and side walls and interior walls defining eight interior rectangular compartments 120 arranged in two horizontal rows with two compartments being located opposite each shuttle assembly in shuttle housing 14. See FIG. 7. The shell includes mounting ears 122 on the opposite ends of the shell. Cap screws 124 extend through holes in the ears of adjacent shells 118 to secure the shells to vertical frame rails 20 as shown in FIG. 2.

A number of pin assemblies 126 are fitted in each compartment 120 in pin housing shell 18. Each pin assembly includes a molded plastic body 128. The bodies have flat rectangular side and top and bottom walls with beveled corners 130. Two contact pins 132 extend outwardly of the front end of the body and are electrically connected to two wound wires 24 extending outwardly from the rear of the body. Slot 136 extends inwardly from the front of the body to define a pair of flexible fingers 138 with a pin 32 extending outwardly from each finger. A latch 140 is provided on the free end of each finger located adjacent the top and bottom wall of the shell. Tall alignment fins 142 extend laterally of the body at the rear of the shell towards the top or bottom of the shell and short alignment fins 144 extend laterally of the body toward the center of the shell. The pin assemblies are each fitted within opposing beveled grooves 146 on opposite sides of a compartment 120 in shell 118 as shown in FIGS. 8 and 9.

During insertion of the pin assemblies latches 140 engage the bottom of adjacent beveled grooves 146 to deflect fingers 138 inwardly towards the adjacent finger and permit movement of the assemblies into the shell 118. When each assembly is fully inserted the fins 142 and 144 seat in complementary slots 148 and 150 extending outwardly from beveled grooves 146 at the rear end of the grooves. In this position the latch 142 falls into locking recess 152 at the front end of the adjacent groove to lock the pin assembly within the shell in a loose but confined fit. See FIGS. 8 and 9. Tall fins 142 extend along the pin assembly body 126 a distance greater than small fins 142 and prevent upside down insertion of the assemblies in the shell. The assemblies can be inserted in the position shown in FIG. 14 only so that latches 140 fall into recesses 152 to confine the pin assemblies in place.

When the shell 118 is fully loaded with pin assemblies as shown in FIG. 7, the pins are aligned in a pattern complimentary to the pattern of terminals 68 in the opposite shuttle assemblies. Compare FIGS. 7 and 10. Shell 118 includes alignment slots 154 extending inwardly from the front edges of top and bottom walls 156. The slots 154 are located opposite alignment slots 42 formed on the top and bottom walls of the shuttle housing shell 30. Slots 154 have the same width as slots 42 and are provided with angled leadins 158 at the front of the shell. The leadins widen the mouth of the slots for receipt of keys 96 into slots 154 during forward movement of the shuttle housings.

Individual pin assemblies 126 may be removed from shell 118 by inserting a tool (not illustrated) into the open front mouth of the shell, engaging the pin extending from the finger carrying latch 140 and flexing the finger as shown in FIG. 14 to move the latch out of the recess 152. The freed pin assembly is then pushed rearwardly and out of the shell.

Cam 26 as shown in FIGS. 17–21 includes an elongate body 160 comprising a pair of similar cam members 162 and 164 located on the top and bottom of the cam and joined to form the body. The two members are similar in shape with the exception that the member 164 has a greater width than member 162 and the lead end or insertion tip 166 of member 162 is spaced longitudinally ahead of corresponding tip 168 of member 164.

Member 162 includes a longitudinally extending flat side surface !70 extending from trailing end 172 to tip 166, a shallow, flat surface 174 angling from the tip rearwardly and away from surface 170 to a short top surface 176 parallel to surface 170. Recessed surface 178 extends rearwardly from the end of top surface 176 to cam trailing end 172.

Member 164 includes a longitudinally extending side surface 180 parallel and adjacent to the surface 170 and separated from surface 170 by a shallow step 182 shown in FIGS. 18 and 21. Tip 168 is located rearwardly of tip 166 and to one side of the tip 166 by the height of step 182. Surface 184 parallels surface 174 and extends rearwardly at the same angle as surface 174 to top surface 186 which is similar to top surface 176. Surface 184 is longer than surface 174. Each surface defines an equal length cam surface engageable with follower surfaces 112 and 114.

Recessed surface 188, similar to surface 178, extends rearwardly from surface 186 to the trailing cam end 172. Surfaces 186 and 188 are separated by relatively high step 190 which has a greater height than shallow step 182. The top and bottom cam walls 192 and 194 are parallel. A short cross pin 196 extends through the trailing end of the cam and serves as a handle to facilitate insertion of the cam into the connector assembly 10 and withdrawal of the cam.

In one embodiment of the invention the electrical connectors 12 are miniature in size having center to center distance between the holes in mounting shell ears 32 and 122 of 1.6 inches. Each electrical connector 10 includes four shuttle assemblies 52 each carrying 32 terminals which engage corresponding pins in the pin housing 18. The entire connector assembly 10 may include 12 electrical connectors spaced in a row as shown in FIG. 1 and is actuated by a 24 inch long cam 26 which is inserted into the aligned openings 44 and 46 to extend and retract the shuttle assemblies 54. Each electrical connector 10 establishes 128 separate electrical connections. The total connector assembly establishes 1,536 electrical connections in a very small space.

A miniature electrical connector 12 includes individual parts, all of which must be manufactured to a certain dimensional tolerance. The locational tolerance for a given surface or feature of one part of the connector is independent of the tolerance for a related feature thus increasing the dimensional tolerances for the assembled shuttle housing 14 and pin housing 18. Additionally, these housings are mounted on rails 20 with a plus or minus tolerance, thereby increasing the dimensional tolerance between the pins in housing 18 and their respective terminals in housing 14. Given the small size of the electrical connectors, molding production tolerances inherent in the various parts and the mounting tolerance, the total anticipated dimensional tolerance between the pins and the terminals in a direction along the length of the connector may be as much as 25% of the center to center distance between adjacent pins and terminals.

The design of the connectors 12 compensates for anticipated dimensional tolerances inherent in the connector design during mating and ensure that the terminals in the shuttle housing engage the proper pins in the pin housing.

Electrical connections are formed between the terminal and pins by extending the cam 26 through the aligned extension openings 44 in the individual connectors to move the shuttle housings from the retracted positions of FIG. 4 to forward to the extended, engaged positions of FIG. 5. See FIG. 22. A cam alignment block (not illustrated) may be provided on the insertion end of assembly 10. This block is of conventional design and has extension and retraction openings like openings 44 and 46 forming extensions of the openings in the shells 30. The block aligns cam 26 to assure that the cam moves properly through openings 44 and 46.

In order to extend the shuttle assemblies 54 to form the electrical connections, the cam 26 is oriented to fit in openings 46. In this position, surfaces 170 and 180 are adjacent the rear wall of openings 48 adjacent short step 52 and surfaces 174 and 184 face forwardly toward the pin housing 18.

The cam 26 is moved into each assembly 10 moving the tips 166 and 168 of the cam members 162 and 164 freely behind follower surfaces 112 and 114 on the front wall of passage 90. Further insertion of the cam into the passage moves cam surfaces 174 and 184 into engagement with surfaces 114 and 112, respectively, to support both sides of the shuttle assembly 54 and move the shuttle assembly forwardly along a straight path, perpendicularly of the cam, toward the pin housing 18. During movement keys 96 hold the shuttle assemblies from lateral shifting. The surfaces 174 and 184 are laterally offset on the cam 26 thereby assuring that they simultaneously engage surfaces 114 and 112 and support the shuttle assembly during the entire forward stroke without cocking. The surfaces 174 and 184 first engage surfaces 112 and 114 at locations the same distance away from top surfaces 176 and 186 so that each follower surface is extended forwardly the same distance by one of the cam surfaces. In this way, extension of the cam extends the shuttle assembly toward the pin housing while supporting the shuttle assembly against cocking.

Extension of the cam moves the shuttle assembly across the space between the shuttle housing and pin housing. Keys 96 are moved outwardly of narrower alignment slots 42 and into the wide beveled lead ins 158 of narrower alignment slots 154. The rounded front corners 98 on keys 96 assure that the keys are captured by the slots 154 despite the alignment errors inherent in a miniature electrical connector. As mentioned above, these errors may be as much as 25 percent of the spacing between adjacent terminals and pins in the assembly.

Further movement of the cam and extension of the shuttle housings toward the pin assembly moves the front of the terminal portions 56 into contact with the rounded ends of the pins 132 held in the pin housing. At this time, the keys 96 have moved past the lead ins 158 and into the narrower slots 154, thereby assuring that the lead in 66 of each pin opening 64 is located over its respective pin 132 so that with final extension of the shuttle assembly the pin is guided into and through the opening and engages the terminal 68 confined within the associated terminal cavity 60. During final extension keys 96 may be moved laterally slightly in slots 154 as the pins move into the cavities and engage terminals 68. The slots 42 are wider than slots 154 and allow the shuttle assemblies, a greater degree of freedom of movement in slots 154. This assures that the assemblies can be moved into slots 154 despite large accumulated dimensional tolerances.

The movement of the cam through the openings 44 shifts the shuttle assemblies toward the pin assemblies as shown in FIG. 22. The shuttle assemblies are fully extended when top surfaces 176 and 186 pass follower surfaces 114 and 112. Frictional engagement between the terminals and pins holds the shuttle assemblies in the extended position. The undercut between the top surfaces and surfaces 178 and 188 prevents further frictional engagement between fully extended shuttle assemblies and the cam during completion of the cam insertion stroke.

The terminal assemblies 126 are mounted in shell 118 with a slight amount of float, allowing slight movement of the assemblies to accommodate engagement with the terminals in the shuttle assembly. The individual contact pins 132 extend freely into the interior of shell 118 and may be flexed upon engagement with lead ins 66 to assure the extension through openings 64 and engagement with the terminals in cavities 60. This freedom of movement facilitates proper mating of the terminals in the pins, despite the very large manufacturing tolerances expected in an electrical connector of very small size.

The angle of cam surfaces 174 and 176 is relatively shallow and the surfaces extend a longitudinal length along the cam approximately equal to the width of each connector 12. During insertion, the cam moves a number of shuttle assemblies forward at the same time to provide a constant load on the cam and prevent undue shocks or loading forces on downstream shuttle assemblies when they are first engaged by the cam. The shallow angle of the cam also reduces the amount of force which must be applied to the cam in order to shift the assemblies.

During insertion of the cam through the twelve connectors 12 making up assembly 10 the aligned extension openings 44 maintain proper cam orientation to assure that the shuttle assemblies of each electrical connector are properly extended without tilting or cocking. After all the shuttle assemblies have been extended the cam is withdrawn.

During extension of each shuttle assembly the folded ribbon cable shown in FIGS. 3 and 4 is extended to accommodate forward movement of the shuttle assembly. Retraction of the assembly returns the finger to the flexed position.

The shuttle assemblies are disengaged from the fitted pin assembly by extending cam 26 through the opening 46 of the alignment block (not illustrated) and through retraction openings 46 in the shuttle housings. The cam is reversed 180 degrees from the extension position so that cam surfaces 174 and 184 face rearwardly and the shallow step 182 is adjacent the short step 52 on the front walls of openings 48. The alignment block assures that the cam is properly aligned as tips 166 and 168 enter the assemblies.

Extension of the shuttle assemblies moved the follower surfaces 112 and 114 on the rear wall 116 of passage 90 adjacent the front walls of openings 48 so that with insertion of the cam into the openings tips 166 and 168 are moved under the follower surfaces on the rear wall and, with further extension of the cam, cam surfaces 174 and 184 simultaneously engage the surfaces 112 and 114 and retract the shuttle assemblies from the engaged position of FIG. 5 to the disengaged position of FIG. 4. During disengagement both sides of the shuttle assemblies are supported on the cam surfaces to prevent cocking or tilting as these assemblies are retracted and the terminals 68 are moved out of engagement from pins 132. Frictional engagement between 32 terminals in each shuttle housing and the corresponding pins in the pin housing subjects the joint between the terminal and cam portions 56 and 58 of each shuttle assembly to considerable tensile loading as the terminals are pulled from the pins. The over molded joint between the plastic in the cam portion and locking projections 74, including the filling of the undercuts on the locking projections and the physical connections between the terminal tails 72 and the plastic in the cam portion, prevents separation of the portions during retraction. The shuttle assemblies are progressively withdrawn from the pin housings as the cam is inserted. Recess surfaces 178 and 188 prevent friction between the cam and the shuttle housings. Keys 96 are protracted into slots 42.

The cam surfaces 174 and 184 engage the opposite sides of the shuttle assemblies during extension and retraction to assure that the assemblies move perpendicularly to the cam without cocking or tilting. Cocking or tilting of the shuttle assemblies during extension increases the possibility of misalignment between the terminals and pins and would considerably increase the force required to engage the terminals and pins. During withdrawal of the pin assemblies misalignment likewise increases frictional forces between the terminals and pins and, as a result, the loading on the joint between the terminal and cam portions of the assemblies.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What is claimed as my invention is:

1. A shuttle assembly for use in a cam operated electrical connector, the assembly including:

a. a terminal portion including a molded plastic body located at the front of the assembly and having a plurality of terminal recesses and openings communicating the recesses with the front of the assembly and a locking projection with undercut sidewalls, a terminal in each recess, each terminal having a contact tail extending rearwardly of its respective recess;

b. a cam portion including an overmolded plastic body located at the rear of the assembly and having an angled cam follower surface facing away from the terminal portion engageable with a transversely extended cam for forward movement of the assembly;

c. a ribbon cable having a portion confined between the terminal portion and the cam follower surface, said ribbon cable portion extending transversely to the contract tails and with said contact tails engaging said confined portion of the ribbon cable to form electrical connections therewith; and d. a longitudinal key on the exterior of the assembly extending past the cable to join the terminal and cam portions together and form an integral assembly, the key including part of said overmolded plastic body molded into engagement with the locking projection and filling said undercut side walls.

2. A shuttle assembly for use in a cam operated electrical connector, the assembly including:

a. a terminal portion located at the front of the assembly and having a plurality of terminal recesses and openings communicating the recesses with the front of the assembly, a terminal in each recess, each terminal having a contact tail extending rearwardly of its respective recess;

b. a cam portion located at the rear of the assembly and having an angled cam follower surface facing away from the terminal portion engageable with a transversely extended cam for forward movement of the assembly;

c. a ribbon cable having a portion confined between the terminal portion and the cam follower surface, said ribbon cable portion extending transversely to the contract tails with said contact tails engaging said confined portion of the ribbon cable to form electrical connections therewith, the ribbon cable being embedded within said cam portion and extending rearwardly of the assembly;

d. an integral connection extending across the cable joining the terminal and cam portions together to form an integral assembly; and e. a cam passage extending transversely through the cam portion with said follower surface located on the forward wall of the passage.

3. A shuttle assembly as in claim 2 including a second follower surface on the rear wall of the passage.

4. A shuttle assembly as in claim 3 wherein each said follower surface includes two transversely spaced surfaces.

5. A shuttle assembly as in claim 2 wherein said cable is embedded in said cam portion to one side of the passage, said assembly including an alignment groove extending from the embedded cable to the passage and alignment holes above the groove extending inwardly from the adjacent side of the cam portion to the cable.

6. A shuttle assembly for use in a cam actuated electrical connector, comprising a terminal portion at the front of the assembly, terminals in the terminal portion, a cam portion at the rear of the assembly, a cam passage extending transversely through the cam portion and an angled cam follower surface located on a wall of the passage, the surface facing away from the terminal portion, and a ribbon cable having a first portion confined between said terminal and cam portions, a second portion embedded within the cam portion and extending from the confined portion rearwardly past the cam follower surface to the rear of the assembly, and an end extending freely from the assembly.

7. A shuttle assembly as in claim 6 wherein said cam follower surface is located on a forward wall of the passage and including a second cam follower surface located on the rear wall of the passage.

8. A shuttle assembly for use in a cam actuated electrical connector, comprising a terminal portion at the front of the assembly, terminals in the terminal portion, a cam portion at the rear of the assembly and having an angled cam follower surface facing away from the terminal portion, a ribbon cable having a first portion confined between said terminal and cam portions, a second portion embedded within the cam portion and extending from the confined portion rearwardly past the cam follower surface to the rear of the assembly, and an end extending freely from the assembly, a locking projection extending from one side of the terminal portion, and a key integral with the cam portion surrounding the locking projection.

9. A shuttle assembly as in claim 8 wherein said cam portion is overmolded on the terminal portion and said key comprises a plastic body integral with said both terminal and cam portions.

* * * * *

UNITED STATES PATENT AND TRADEMARK OFFICE

CERTIFICATE OF CORRECTION

PATENT NO. : 4,931,022

DATED : June 5, 1990

INVENTOR(S) : Douglas A. Neidich

It is certified that error appears in the above—identified patent and that said Letters Patent is hereby corrected as shown below:

Column 1, line 35, insert "of" after --means--.

Column 2, line 23, delete "a"; line 35, delete "are"; and line 45, delete "a".

Column 3, line 9, change "413 4" to --4--4--; line 36, change "18" (second occurrence) to --19--.

Column 4, line 61, change "project" to --projecting--.

Claim 1, column 11, line 4, change "contract" to --contact--.

UNITED STATES PATENT AND TRADEMARK OFFICE

CERTIFICATE OF CORRECTION

PATENT NO. : 4,931,022

DATED : June 5, 1990

INVENTOR(S) : Douglas A. Neidich

It is certified that error appears in the above-identified patent and that said Letters Patent is hereby corrected as shown below:

Claim 2, column 11, line 32, change "contract" to --contact--.

Signed and Sealed this

Fifteenth Day of October, 1991

*Attest:*

HARRY F. MANBECK, JR.

*Attesting Officer*

*Commissioner of Patents and Trademarks*